United States Patent [19]

Cummins

[11] 4,044,980

[45] Aug. 30, 1977

[54] COLLAPSIBLE DESKTOP STAND FOR PORTABLE ELECTRONIC CALCULATOR

[75] Inventor: Victor Cummins, Burbank, Calif.

[73] Assignee: Cummins Enterprises, Burbank, Calif.

[21] Appl. No.: 679,980

[22] Filed: Apr. 26, 1976

[51] Int. Cl.[2] ..... F16F 15/00; A47B 97/04

[52] U.S. Cl. ..... 248/13; 248/456; 248/459; 248/460

[58] Field of Search ..... 248/13, 454, 455, 456, 248/459, 460; 240/120

[56] References Cited

U.S. PATENT DOCUMENTS

| | | | |
|---|---|---|---|
| 669,009 | 2/1901 | Ingraham | 248/456 |
| 1,869,278 | 7/1932 | Ramelli | 248/455 |
| 2,014,176 | 9/1935 | Henderson | 248/456 |
| 2,662,333 | 12/1953 | Bargen | 248/455 |
| 3,121,884 | 2/1964 | Emery | 248/455 |
| 3,885,762 | 5/1975 | Sebastiani | 248/13 |

*Primary Examiner*—Robert A. Hafer

*Attorney, Agent, or Firm*—Fulwider, Patton, Rieber, Lee & Utecht

[57] ABSTRACT

A one-piece collapsible stand, formed of a flexible plastic material, such as polypropylene, for holding a portable electronic calculator or the like in any of a plurality of selectable inclined positions on a desktop, comprising a rectangular base platform having a backrest adapted to hold the calculator, the backrest being joined to one end of the base by a thin integral web and a brace plate for supporting the backrest in inclined position, the brace plate being joined to the opposite end of the base by a like integral web. The backrest and the brace plate swing about the opposite ends of the base platform between an assembled state in which they releasably engage each other above the base platform and a collapsed state in which the backrest, the base platform and the brace plate are held substantially flat against one another for packing and storage.

4 Claims, 5 Drawing Figures

COLLAPSIBLE DESKTOP STAND FOR PORTABLE ELECTRONIC CALCULATOR

BACKGROUND OF THE INVENTION

This invention relates generally to desktop stands for portable electronic calculators and the like and, more particularly, to a novel one-piece collapsible stand formed of a flexible plastic material which is lightweight, durable and inexpensive to manufacture.

In recent years there has been a tremendous rise in the availability and popularity of hand-held portable electronic calculators. The development of sophisticated integrated circuit technology has enabled these calculators to be made compactly and inexpensively. To a great extent, portable calculators are capable of performing most, if not all, of the functions available in standard desktop calculators.

One of the few remaining disadvantages of the portable calculator over desktop models is that it is incapable, by itself, of resting on a desktop with its keyboard surface at an optimal angled position for the user. An initial step in overcoming this problem has been the provision of a small desktop stand to hold the portable calculator in an inclined position. Such a stand is disclosed, for example, in U.S. Pat. No. D238,916.

However, such calculator stands heretofore have been complexly designed of multiple interconnected pieces formed of a relatively heavy, brittle plastic. As a result, manufacture and marketing of these stands has necessitated relatively high material and labor costs and substantial shipping expenses. Further, they are easily susceptible to breakage if dropped and the individual pieces can become detached from one another and lost.

Consequently, those concerned with the design and use of desktop calculator stands are highly aware of the need for a simplified and reliable stand which is lightweight, durable, inexpensive to manufacture and can be compactly packaged for shipping and storage. The present invention clearly fulfills this need.

SUMMARY OF THE INVENTION

Briefly, and in general terms, the present invention provides a reliable one-piece collapsible desktop calculator stand formed of a flexible plastic material to yield a simple, lightweight, durable and inexpensive structure.

Basically, the present invention comprises a base portion adapted to rest on a desktop, a backrest portion adapted to hold the calculator thereon and a brace portion for supporting the backrest portion in an inclined position relative to the base portion. The backrest portion and the brace portion are hingedly connected to the base portion at opposite ends thereof by thin integral webs which enable them to swing to an assembled state in which the brace portion can be fixed to the backrest portion for support thereof in an inclined position above the base portion. The brace portion can be detached from the backrest portion for collapsing the stand into a substantially flat unit for packing and storage. This one-piece stand can be injection-molded very inexpensively and is extremely lightweight and compact in the collapsed condition for packaging and shipping.

More specifically, and in a presently preferred embodiment, by way of example but not necessarily by way of limitation, a collapsible one-piece calculator stand embodying various features of the invention may include a generally rectangular base platform resting on a desktop or other work surface having a generally rectangular backrest, defined by face and rear surfaces, hingedly connected to one end thereof by a first thin integral web enabling the backrest to swing over the base platform in acute angular relationship therewith, and a generally rectangular brace plate hingedly connected to the opposite end of the base platform by a like second integral web enabling the brace to engage the backrest for support above the base platform. The stand is preferably formed of polypropylene to yield webs which can endure many more bends without cracking or breaking than such a stand will be subjected to in normal use. A forwardly projecting flange is integrally formed on the backrest near its connection with the base platform for support underneath the calculator. The brace plate and the backrest have cooperating tab and slot elements which releasably interconnect to fix one to the other in this assembled state. The result of this novel stand design is a stable desktop support for the calculator.

In accordance with another aspect of the invention, this one-piece stand collapses into either of two substantially flat configurations for shipping and storage. In one configuration, the brace plate can be disengaged from the backrest and swung away from the base platform into essentially coplanar alignment therewith. The backrest, which is slightly wider than either the base platform or the brace plate and has short rearwardly projecting walls integrally formed along its side edges, can then be swung down thereon with a snug holding fit which prevents it from springing up due to any spring force in the first integral web. When so collapsed, the stand occupies a near minimum of space for packing or storage, is restrained against springing outwardly to make packaging in blister packs or thelike practical, and is small and light enough to be carried easily in a shirt pocket or a briefcase.

In a second collapsed configuration, the brace plate is swunt in towards the base platform before the face plate is collapsed thereon. With the brace plate thus sandwiched between the base platform and the face plate, the stand is most compactly collapsed for packaging. However, since both webs are folded, thereby exerting forces tending to spring the pieces apart, this method of folding the stand is intended for packaging it in cardboard boxes or the like which can hold the stand against such action.

The collapsible one-piece calculator stand of the present invention satisfies a critical need for a simple, reliable, durable and lightweight structure which minimizes manufacturing and shipping expenses.

The above and other objects and advantages of this invention wil be apparent from the following more detailed description when taken in conjunction with the accompanying drawing of an illustrative embodiment.

DETAILED DESCRIPTION

Figure 1:
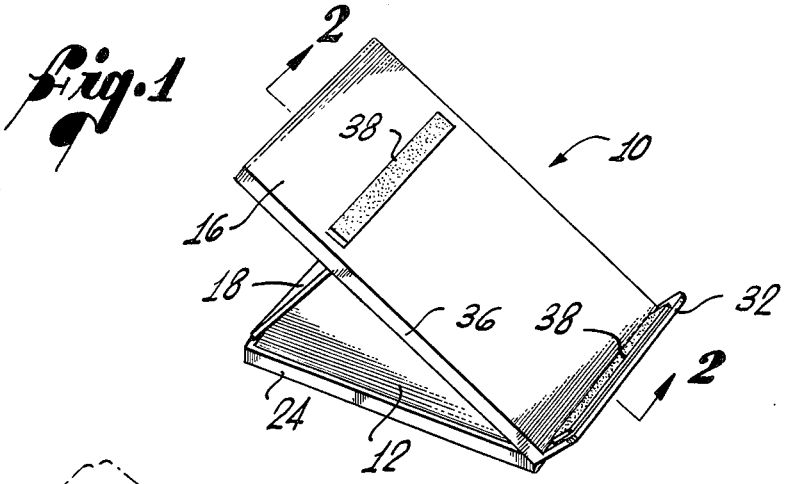
FIG. 1 is a perspective view showing an assembled stand in accordance with a presently preferred embodiment of the invention.
Figure 2:
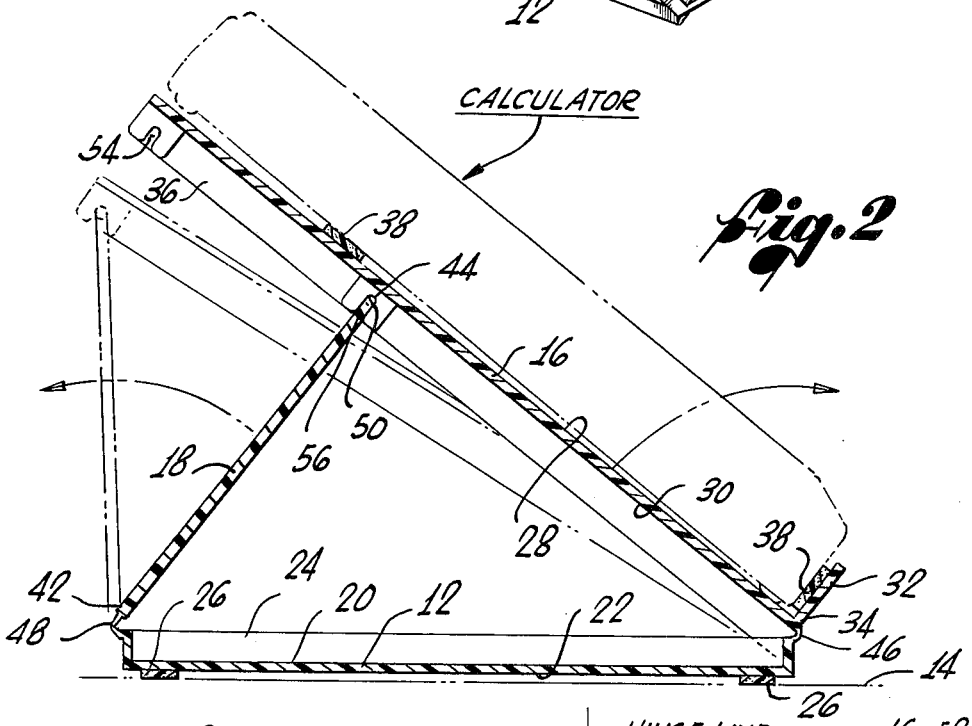
FIG. 2 is a cross-sectional view of the stand, taken along the lines 2—2 in FIG. 1, and showing the stand in one assembled state, a second alternative assembled state being shown in phantom.
Figure 3:
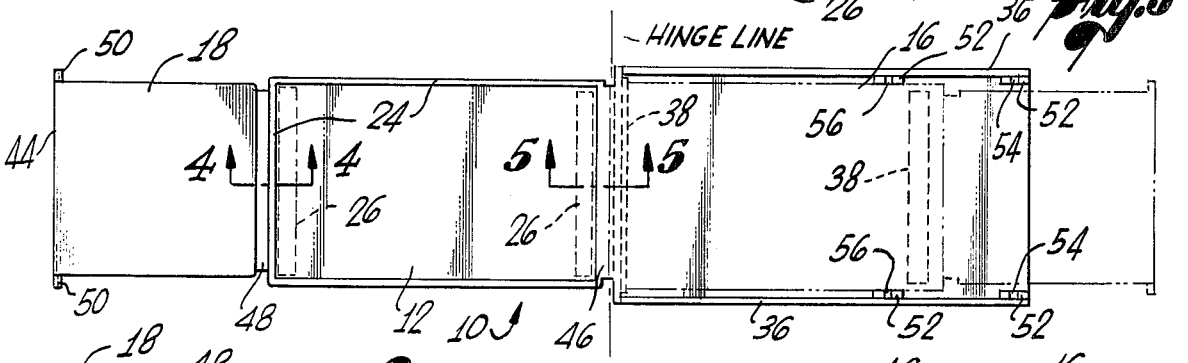
FIG. 3 is a top plan view of the stand in a disassembled condition, one collapsed configuration being shown in phantom.

Referring now to the drawing, and particularly to FIGS. 1, 2 and 3 thereof, there is shown a collapsible one-piece calculator stand 10 constructed in accordance with a presently preferred embodiment of the invention. The stand 10 includes a base 12 resting on a work surface 14, which typically may be a desktop or table top, a backrest 16 holding a calculator or the like (shown in phantom in FIG. 2 only), and a brace 18 supporting the backrest in inclined relation to the base. The stand 10 is formed as a single unit of polypropylene, as described hereinafter.

The base 12 comprises a rectangular platform formed by a thin plate having an upper surface 20 and a lower surface 22 extending in longitudinal and transverse directions with a relatively short upstanding wall 24 integrally formed about its entire periphery to strengthen it against longitudinal and transverse flexing. A narrow, elongated strip 26 of frictional material, such as rubber, is fixed transversely to the lower surface 22 of the base 12 near each end thereof to frictionally restrain the stand 10 against sliding movement when it is resting on the work surface 14.

With reference to an assembled state of the stand 10, as shown in FIGS. 1 and 2, the backrest 16 comprises a thin rectangular plate having a face surface 28 supporting the back surface of the calculator and a rear surface 30 extending in longitudinal and transverse directions. A forwardly projecting flange 32 is integrally formed normal to the face surface 28 transversely along one hinged end 34, which is hingedly connected to the base 12 as hereinafter described, to provide support underneath one end of the calculator. A relatively short, rearwardly projecting wall 36 is integrally formed longitudinally along each side edge of the backrest 16, one function of which is to strengthen the backrest against longitudinal flexing under the weight of the calculator. Narrow strips 38 of frictional material are likewise fixed on the flange 32 and the face surface 28 to resist sliding of the calculator thereon.

The brace 18 comprises a thin rectangular plate extending in longitudinal and transverse directions and having a hinged end 42 hingedly connected to the base 12 and an opposite engagement end 44 for connecting with the backrest 16.

Figure 4:
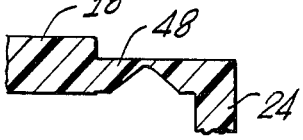
FIG. 4 is an enlarged, fragmentary sectional view of one of the hinge webs, taken along lines 4—4 in FIG. 3.
Figure 5:
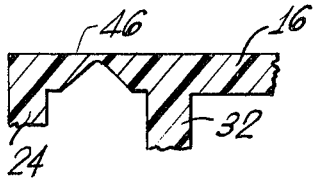
FIG. 5 is an enlarged, fragmentary sectional view of another of the hinge webs, taken along lines 5—5 in FIG. 3.

Referring to FIGS. 2, 4 and 5, the hinged end 34 of the backrest 16 and the hinged end 42 of the brace 18 are connected to the opposite ends of the base 12 respectively, along the top edge of the upstanding wall 24, by integrally formed webs 46 and 48, respectively, to enable these elements to swing between an assembled state, in which the brace engages the backrest for support thereof in an inclined position above the base with the face surface 28 facing outwardly, and a collapsed state in which each element can be made to lie substantially flat with the others for packaging and storing the stand 10. The combined lengths of the brace 18 and the backrest 16 must, of course, be substantially greater than the length of the base 12 to enable the former to engage above the latter.

The webs 46 and 48 extend transversely along each end of the base 12 and are shown in FIGS. 4 and 5 as tapering to a minimum thickness from each side thereof, although it will be appreciated that they could be of uniform thickness if appropriately thin. The webs 46 and 48, of course, are formed of polypropylene, which is very durable and is known to withstand thousands of bends in this "living hinge" configuration, as it is sometimes known. Hence, the webs 46 and 48 will withstand much higher duty than they will normally be called upon to endure in any practical use of the stand 10. Further, using the living hinge enables the entire structure, with the minor exception of the frictional strips 26 and 38, to be injection-molded as a single piece in one simple and economical manufacturing process.

In order to releasably fix the brace 18 to the bracket 16 in an assembled state of the stand 10, the former is supplied with integrally formed tabs 50 projecting transversely beyond its side edges along the engagement end 44 thereof which snugly interconnect with rearwardly opening slots formed in thickened portions 52 of the interior of the backrest side walls 36. A pair of longitudinally registered slots 54 is provided at the end opposite the hinged end 34 of the backrest 16 and another pair 56 is provided spaced from said opposite end. Although the longitudinal separation of these slot pairs yields only a small angular difference in the inclined position of the backrest, such a change is usually all that is necessary to avoid the annoying reflection of light on the numerical display of the calculator which occasionally is encountered.

As best seen in FIG. 3, the base 12, the backrest 16 and the brace 18 are optimally designed to lie substantially flat with one another in one of two alternative collapsed states for compact packaging. In this regard, the backrest 16 is slightly wider than the base 12, which, in turn, is slightly wider than the brace 18. When the stand 10 is disassembled, each element lies essentially coplanar with the other and the webs 46 and 48 are in a relaxed condition and the flange 32 oriented downward. From this state, the brace 18 and the base 12 can be swung as a unit about the hinged end 34 of the backrest 16 to be received between the side walls 36 thereof to form one collapsed configuration (shown in phantom). The sides of the base 12 engage the thickened portions 52 of the backrest side walls 36 with a snug holding fit which holds these elements together against the spring force of the folded web 46. This feature is important for enabling the stand 10 to be packaged in inexpensive containers, such as blister packs and the like, without springing out against the sides of such container, and for carrying it in shirt pockets or briefcases.

The second collapsed configuration, not illustrated in the drawing, is formed, from the disassembled condition of the stand 10, by first folding the brace 16 flat against the base 12. These elements are then folded as a unit about the hinged end 34 of the backrest 16 as before, forming a more compact unit since the brace 18 no longer projects beyond the backrest 16. However, it is to be noted that in this condition both web 46 and web 48 are folded and their combined spring force can act to prevent the stand elements from lying flat against one another. Therefore, this second collapsed configuration is adapted to be utilized with sturdier packaging, such as cardboard boxes, which can hold the stand 10 against springing outwardly.

It will be apparent that the stand 10 may also be used as a convenient support for other instruments, such as transistor radios and pocket-size tape recorders, which might be conveniently utilized in inclined position on a work surface.

The present invention satisfies a long existing need for a lightweight, durable, stable and inexpensive stand for portable electronic calculators and the like. It will be apparent from the foregoing that, while a particular form of the invention has been illustrated and described, various modifications can be made without departing from the spirit and scope of the invention.

I claim:

1. A collapsible one-piece stand for supporting a portable electronic calculator or the like on a work surface in inclined relation thereto, comprising:

a base portion formed by a thin rectangular plate having an upper and a lower surface extending in longitudinal and transverse directions, said upper surface having relatively short upstanding walls integrally formed along opposite end and side edges thereof for structural rigidity, said lower surface adapted to rest on said work surface and having means for resisting sliding movement therebetween;

a backrest portion comprising a thin rectangular plate adapted to hold said calculator thereon, said plate having a face surface and a rear surface extending in longitudinal and transverse directions, said face surface having a forwardly projecting, integrally formed flange extending transversely along a first end thereof to provide support underneath said calculator, and said rear surface having short rearwardly projecting, integrally formed side walls extending longitudinally along opposite side edges thereof, said side walls having at least one pair of rearwardly extending slots in register with each other near the end opposite said first end;

a brace portion comprising a thin rectangular plate extending in longitudinal and transverse directions having a first end and a second end, said second end of said brace portion having transversely projecting tabs extending beyond the side edges thereof;

said base portion, said backrest portion and said brace portion integrally formed as a single unit of a flexible plastic material, said first end of said backrest portion hingedly connected to one end of said base portion by a transversely extending thin integral web, and said first end of said brace portion hingedly connected to the opposite end of said base portion by a like integral web, said backrest portion and said brace portion swingable about the opposite ends of said base portion between at least one assembled state in which said brace portion engages said backrest portion for support thereof in an inclined position with said face surface facing outwardly and at least one collapsed state in which said backrest portion and said brace portion lie substantially flat with said base portion; and said tabs receivable within said slots with a snug fit for releasably fixing said brace portion to said backrest portion in an assembled state.

2. A collapsible one-piece stand as defined in claim 1, wherein said flexible plastic material is polypropylene.

3. A collapsible one-piece stand as defined in claim 2, wherein said means for resisting sliding movement between said base portion and said work surface comprises at least one strip of frictional material fixed to said lower surface.

4. A collapsible one-piece stand as defined in claim 2, wherein said backrest portion side walls are transversely spaced to receive said base portion side walls with a snug holding fit in a collapsed state to hold said backrest portion and said base portion substantially flat against one another.

* * * * *